US007419125B2

(12) United States Patent
Simone

(10) Patent No.: US 7,419,125 B2
(45) Date of Patent: Sep. 2, 2008

(54) BABY BOTTLE LEASH

(76) Inventor: Rachelle K. Simone, 9424 Glendale Ave. NE., Albuquerque, NM (US) 87122

( * ) Notice: Subject to any disclaimer, the term of this patent is extended or adjusted under 35 U.S.C. 154(b) by 135 days.

(21) Appl. No.: 11/432,458

(22) Filed: May 11, 2006

(65) Prior Publication Data

US 2006/0255214 A1 Nov. 16, 2006

Related U.S. Application Data

(60) Provisional application No. 60/692,693, filed on Jun. 20, 2005, provisional application No. 60/684,662, filed on May 25, 2005, provisional application No. 60/681,331, filed on May 13, 2005.

(51) Int. Cl.
*A47D 15/00* (2006.01)

(52) U.S. Cl. ..... 248/102; 24/302; 24/306; 248/205.2

(58) Field of Classification Search ..... 248/102, 248/104, 205.1; 24/3.13, 301, 302, 306, 24/398, 442; 224/148.6, 250, 254, 572
See application file for complete search history.

(56) References Cited

U.S. PATENT DOCUMENTS

| | | | | |
|---|---|---|---|---|
| 4,989,811 | A * | 2/1991 | Millis et al. | 248/104 |
| 5,265,834 | A * | 11/1993 | Daniels | 248/104 |
| 5,927,661 | A * | 7/1999 | Tinsley et al. | 248/102 |
| 2004/0079843 | A1 * | 4/2004 | Medwed et al. | 248/104 |
| 2005/0115996 | A1 * | 6/2005 | Deike | 224/148.6 |
| 2005/0176341 | A1 * | 8/2005 | Watt | 446/227 |
| 2006/0196996 | A1 * | 9/2006 | Clark et al. | 248/104 |

FOREIGN PATENT DOCUMENTS

FR 2883147 * 9/2006

* cited by examiner

*Primary Examiner*—Ramon O Ramirez
(74) *Attorney, Agent, or Firm*—Richard K. Thomson

(57) ABSTRACT

A leash for a baby bottle or other food/beverage container has a padded band with a redundant attachment to the shoulder harness strap of a car seat, or the like. Similarly, the second attachment strap for attaching to the bottle has a redundant set of latches to ensure that the bottle is held thereby. The strap suspending the bottle has a dangle length of 3" to 5" to maintain the bottle within easy reach of the child obviating intervention by the parent to restore control of the container to the baby. The second attachment strap is provided with a non-slip fabric for engaging the surface of the container.

11 Claims, 4 Drawing Sheets

BABY BOTTLE LEASH

BACKGROUND AND SUMMARY OF THE INVENTION

Applicant claims priority of provisional patent application 60/681,331 filed May 13, 2005, provisional patent application 60/684,662 filed May 25, 2005, and 60/692,693 filed Jun. 20, 2005.

One of the (many) difficulties in traveling with infants and young children, is keeping them entertained. If the child is hungry or thirsty, often a bottle or sippy cup will serve to provide the parent(s) a brief respite from the vocal displeasure of a cranky passenger. All too often, however, the solution to the crabbiness problem becomes, instead, a problem in itself. The baby repeatedly drops the drink/liquid-food container requiring the non-driving parent to unfasten their seat belt and lean over the seat-back to gain access to the container which is, doubtlessly, rolling around on the floor in the least reachable location possible. This procedure is both aggravating and difficult for even the most well-conditioned parent, as well as a distraction to the driver. Should there be only a single adult in the vehicle, the maneuver, to be properly and safely done, requires stopping the vehicle by the roadside to afford the driver free hands to access the drink container. Depending on the traffic flow and neighborhood of the mishap, this technique may not be all that safe, either. An equally aggravating, if generally safer, time awaits the parent pushing a stroller through the mall with the added complication that the dropped container may go undetected for a number of stores.

Several attempts at dealing with this situation have appeared in the patent literature. Some of these developments ease the parent's difficulty of locating the container: they need merely follow the string which is tied to the car seat to its end and, voila!, there's the baby's bottle. However, the retrieval still requires the non-driving parent (if any) to unfasten their seat belt and rummage around in the back seat to restore the drink container to the child. Another problem which arises with some of the available bottle suspenders is that the shoulder strap connections and the bottle attachments can both be tampered with. When the child has drunk her/his fill and is looking for an alternate form of entertainment, these disconnectable devices provide an all-too-ready "toy", defeating this supposed solution to the "bottle drop" problem.

It is a primary object of the present invention to provide a bottle/beverage container leash which maintains the bottle within easy reach of the child. This has two principle advantages: 1) it enables the child to develop her/his own manual dexterity skills and, 2) it preserves the sanity and cheery disposition of the parent. This is accomplished by having a short (on the order of 3-5 inches) leash which attaches to the seat belt harness or shoulder strap of a stroller in the area of the child's chest region. This keeps the container within easy reach should the elusive bottle slip from her/his grasp. In addition, the securement means attaching the leash to the shoulder strap and the latching means attaching the leash to the bottle are fail-safe: each of them has a back-up, at least one of which is not easily manipulated by the child.

The leash system of the present invention includes a) a strap having a first and second end; b) a first attachment band secured to the first end of the strap for suspending the leash system from a shoulder strap of a seatbelt harness, or the like, the attachment band having a first and a second securement means for suspending the leash from the shoulder strap; c) a second attachment band secured to said second end of the strap for securely attaching to the child's drink container, the second attachment band having first and second latching means for securing the attachment band to the child's drink container; whereby the first and second securement means and the first and second latching means provide a fail-safe leash system for maintaining the child's drink container within reach of a thirsty child. Preferably, the second securement means protects the first securement means from being tampered with. In addition, the second securement means preferably comprises a padded fabric band to ensure the child's comfort.

The first securement means most preferably comprises a clip which attaches to the shoulder strap and the fabric band of the second securement means wraps around the clip. Virtually any type of clip can be used including suspender clips, buckles, key rings, glides, slides, D-rings, hook buckles, snap hook Arabia belt buckles, side release clips, center release clips, camp locks, binder clips, belt buckles, snaps, buttons, zippers, alligator clips, and any other type of clip. The fabric band of the second securement means is retained in a wrapped position by first and second portions of hook-and-loop (VELCRO) fabric. The clip is preferably selected from a group consisting of an alligator clip, a snap, a button, and a suspender clip, with the latter having been found to be most successful in keeping the child from tampering with it, even if she/he succeeds in opening the fabric band. The clip is sewn inside the fabric band to avoid its being misplaced. An optional feature of the bottle leash of the present invention is that the strap has an adjustable length.

The first latching means comprises a width of fabric whose length can be adjusted to accommodate different diameter containers. The length-adjustable fastening means comprises third and fourth portions of hook-and-loop fabric. The length of these third and fourth portions of fabric are longer than necessary to accomplish the attachment providing significant adjustability. The second latching means comprises a two-part, snap-together buckle, a first part secured to a distal end of a first strap and a second part secured to a distal end of a second strap, the first and second straps overlying and being attached to the width of fabric constituting the first latching means. Most preferably, a length B of the first latching means is not exceed by a length A of the strap. This ensures that the bottle is maintained with the ready reach of the child.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
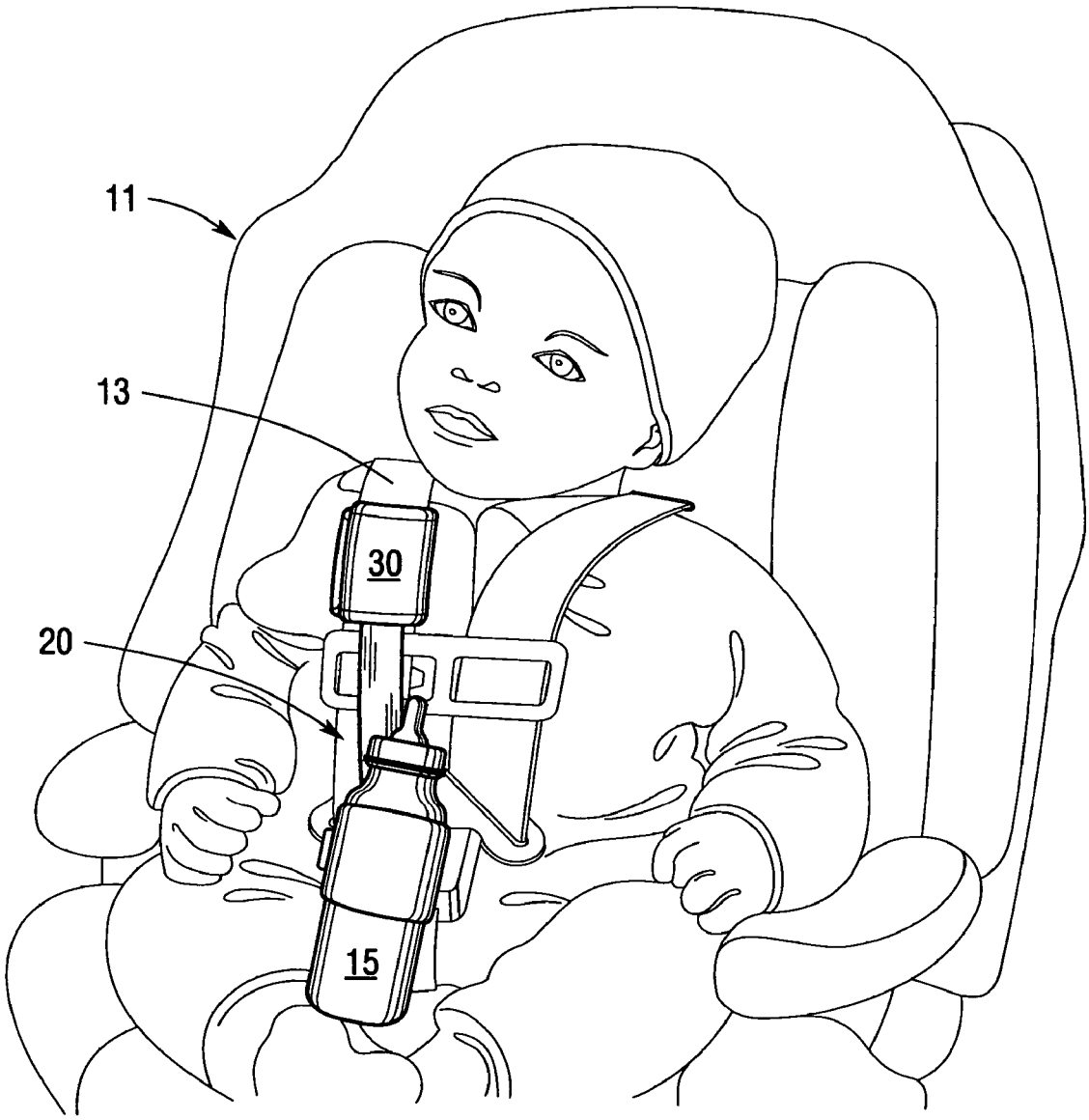
FIG. 1 is a perspective front view of a first embodiment of the baby bottle leash of the present invention shown attached to a car seat.
Figure 2:
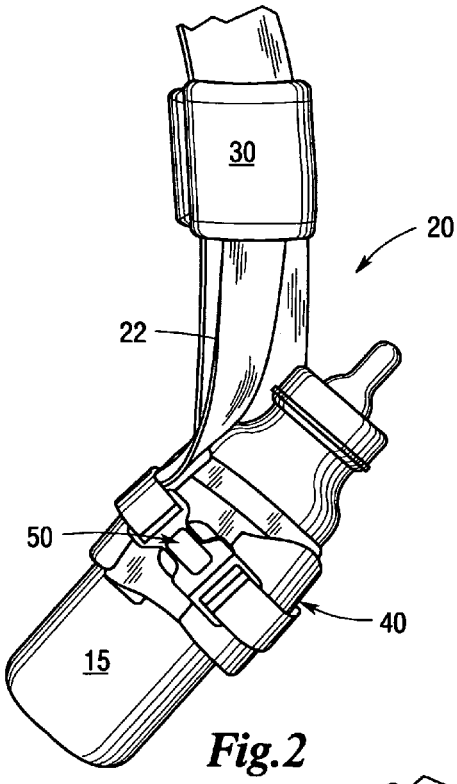
FIG. 2 is a detailed front view of the first embodiment of the baby bottle leash of the present invention with the bottle turned to enhance depicting certain details.
Figure 4A:
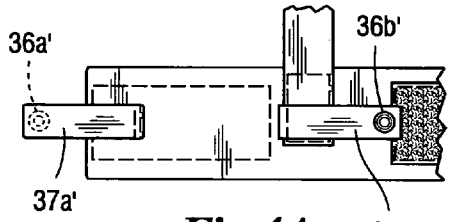
FIG. 4A is a partial front view of a second embodiment of the baby bottle leash of the present invention.
Figure 4B:
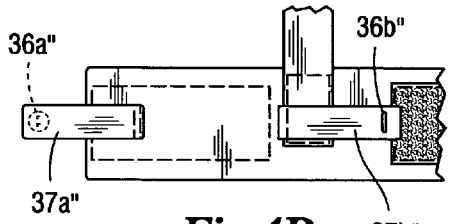
FIG. 4B is a partial front view of a third embodiment of the baby bottle leash of the present invention.
Figure 4:
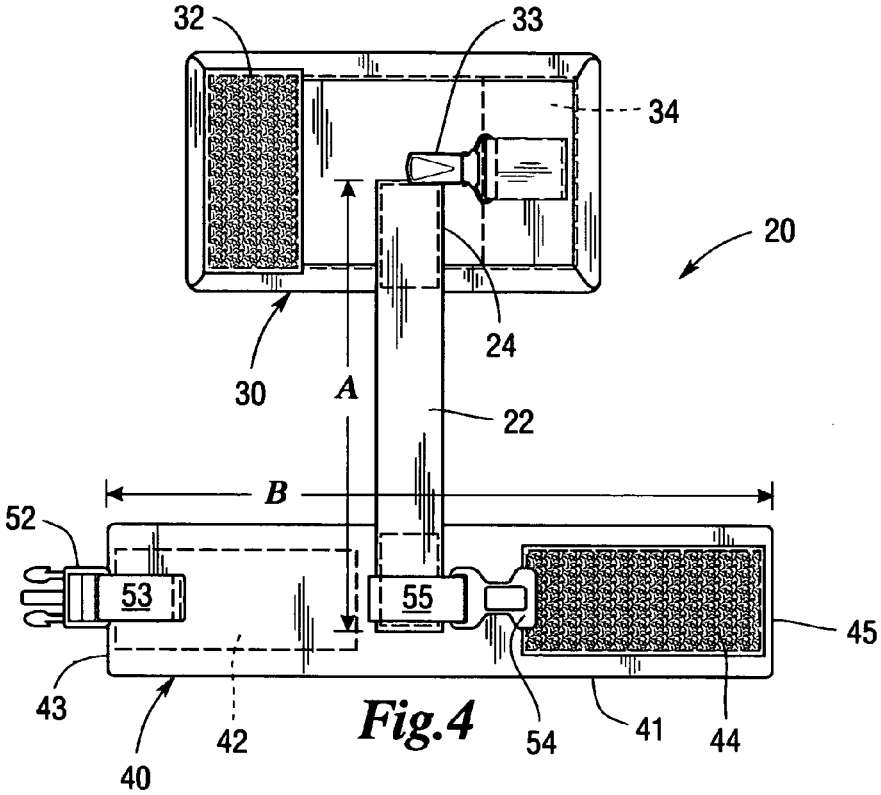
FIG. 4 is a front view of a first embodiment of the baby bottle leash of the present invention.
Figure 5:
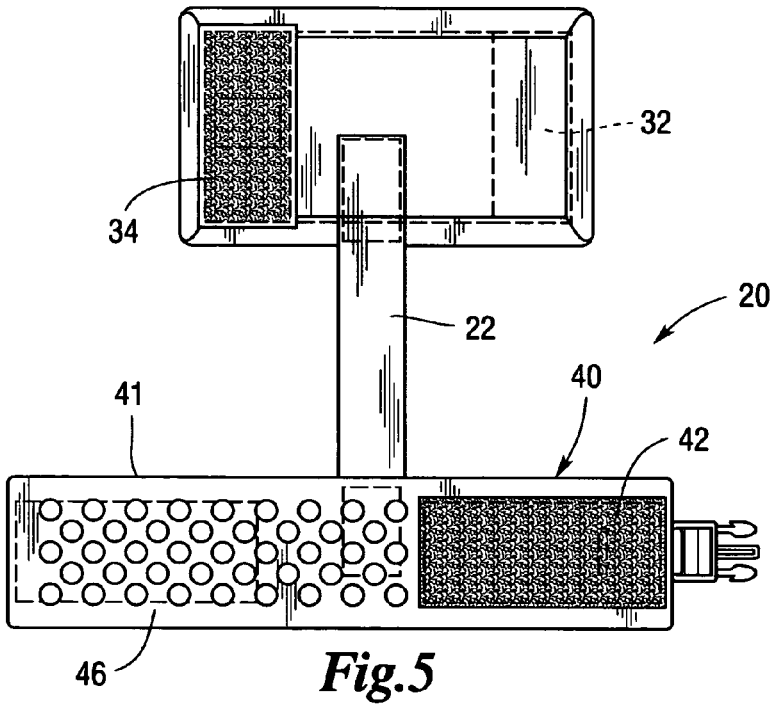
FIG. 5 is a back view of a first embodiment of the baby bottle leash of the present invention.

A first embodiment of the baby bottle leash is shown in FIGS. 1, 2, 4 and 5 generally at 20. As best seen in FIGS. 4 and 5, leash 20 is comprised of a strap 22 which has a length A extending between first end 24 and second end 26, with a first attachment band 30 secured to first end 24 of strap 22 as by stitching. Strap 20 is made of a non-stretch fabric such as canvas or a woven cotton or nylon, for example. First attachment band 30 has a first securement means in the form of first (32) and second (34) portions of hook-and-loop fabric attached as by stitching to opposite ends. Most 20 preferably, first attachment band 30 is padded for the child's comfort since, as shown in FIG. 1, when it is secured to the shoulder harness strap 13 of car seat 11, it will come in contact with the child's shoulder/chest region. While it is possible for strap 20 to be constructed to be of adjustable length, it is not regarded as an essential feature of the leash of the present invention since the positioning of the bottle can be controlled by the positioning of the first attachment band on the shoulder harness strap. Strap 20 has an overall length A on the order of 6" to 8" providing an effective "dangle length" of 3" to 5". The dangle length is defined as the distance between first attachment band 30 and second attachment band 40. Although the baby bottle leash 20 of the present invention is described in conjunction with a car seat, it will be appreciated that it can also be used with a stroller, play station, layette, high chair, or other device.

Figure 3:
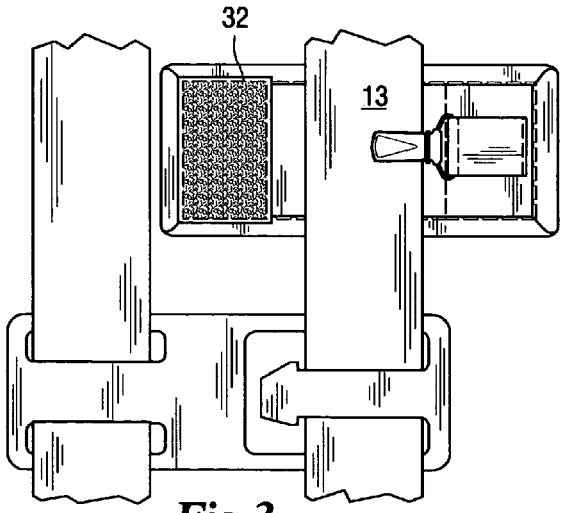
FIG. 3 is a detailed rear view of the first embodiment of the baby bottle leash of the present invention showing how it attaches to the right shoulder strap.

Confined within first attachment band 30 is a clip 36 which securely fastens to the shoulder harness strap 13 (FIG. 3) and then band 30 is wrapped around the harness strap 13 and the first (32) and second (34) hook-and-loop fabric portions engaged to retain it in secured position at the desired location to position the bottle 15 as shown in FIG. 1. When so positioned, the bottle may be easily retrieved by the child should he/she momentarily lose his/her grip of it. Clip 36 may be an alligator clip or a suspender clip, with the latter being shown and preferred. By the use of the clip 36 to positively fix the position of the band 30 on the shoulder harness strap 13, the baby bottle leash cannot slide up or down on the strap 13 thereby mis-positioning the bottle 15. In addition, while the size of the first (32) and second (34) hook-and-loop fabric portions makes the band 30 "tamper-proof" for most children, the redundancy of clip 36 makes the attachment provided by band 30 "failsafe".

A second attachment band 40 is secured to the second lower end 26 of strap 22 as by stitching. Second attachment band 40 has a first latching means in the form of a fabric strip 41 having a length B. It should be noted that the length A of suspension strap 22 does not exceed the length B of fabric strip 41 which secures the bottle 15. This ensures that the bottle 15 remains within the grasp of the child in the car seat 11. Fabric strip 41 has a third elongated strip of hook-and-loop fabric 42 sewn on a first end 43 and a fourth elongated strip of hook-and-loop fabric 44 sewn on second opposing end 45. These elongated lengths of attaching fabric afford the capability to accommodate varying sizes of containers such as bottles, sippy cups, etc. To further enhance this capability, fabric 42 is preferably made of a stretchable material such as SPANDEX fabric, or the like. Stitched to a second side of fabric strip 41, opposite from first elongated hook-and-loop fabric strip 42, is a non-slip fabric 46 designed to secure the bottle 15. Non-slip fabric 46 is preferably elastomeric, being made of rubber or a rubber like material which accommodates the stretching of fabric strip 41. By way of example and not limitation, in this embodiment, first attachment band may measure 3.5" by 6.25" and the second attachment band may measure 2.5" by 11".

Second latching means, in the FIG. 4-5 embodiment, comprises a two part, snap-together buckle 50 (FIG. 2) having first male member 52 and second female member 54. As shown in FIG. 4, male member 52 is stitched to an end of elastic 53 and female member 54 is stitched to the end of elastic 55 which is anchored to the end 26 of strap 22. By using elastics 53, 55, buckle portions 52, 54 can be stretched over the outside of fabric 41 after first and second hook-and-loop fabric portions are engaged to secure fabric 41 around bottle 15. Second latching means 50 secures first latching means 41 against possible tampering by the child should he/she become bored with the bottle 15. It is envisioned that other second latching means 50" and 50" shown in FIGS. 4A and 4B respectively, could take the form of snaps and buttons.

The second snap embodiment is depicted in FIG. 4A with the male snap 36A' being mounted on elastic 37A' and the female snap 36B' mounted on elastic 37B'. FIG. 4B depicts the third button embodiment in which the button 36A" is mounted on elastic 37A" and the button hole 36B" is mounted on elastic 37B". The snaps 36' and the buttons 36" work in exactly the same manner as the buckle 36 of the FIG. 4 embodiment, wrapping around fabric strip 41 to act as a redundant latching means that prevents tampering by the child or other undesired release of bottle 15.

Figure 6:
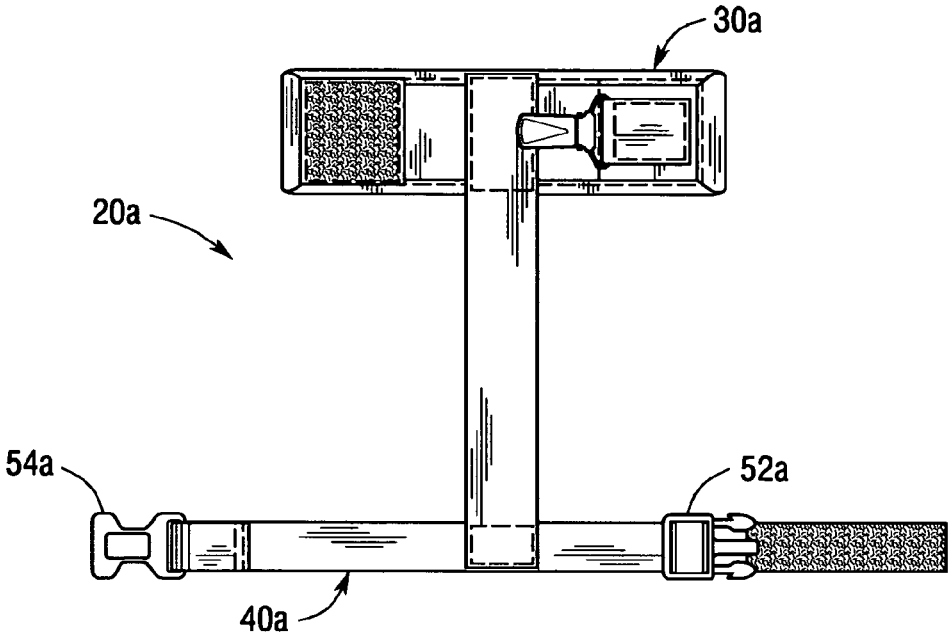
FIG. 6 is a front view of a fourth embodiment of the baby bottle leash of the present invention; and, FIG. 7 is a back view of a fourth embodiment of the baby bottle leash of the present invention.
Figure 7:
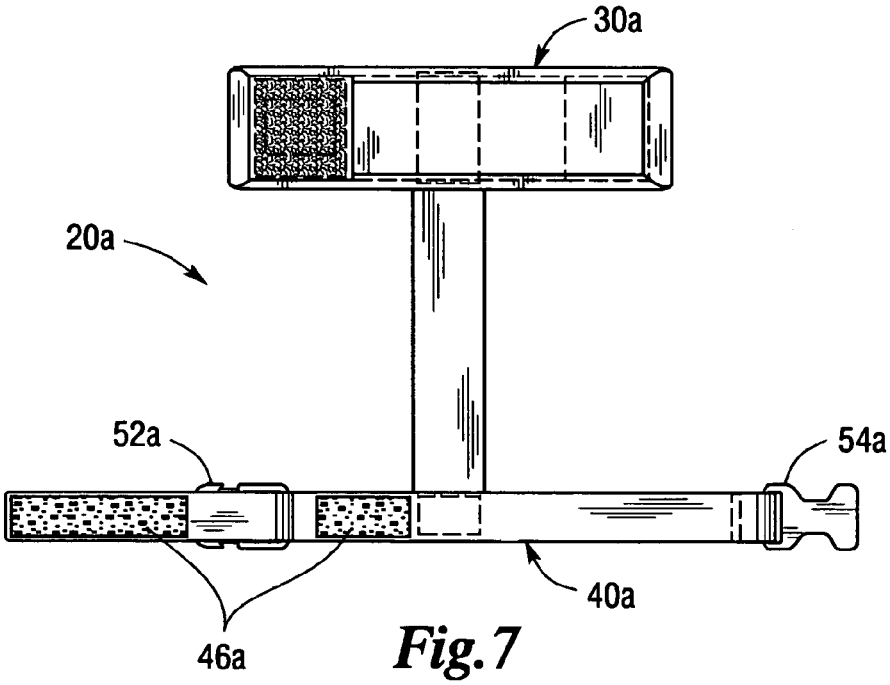

A fourth embodiment of the baby bottle leash is shown in FIGS. 6 and 7 generally at 20*a*. The operation of this fourth embodiment is substantially identical to that of the first three embodiments. The key differences are in the sizes of the first (30*a*) and second (40*a*) attachment bands. Again, by way of example and not limitation, first attachment band 30*a* measures 1.875" by 6.25" long. This change in size results, not only in a saving of fabric, but makes the first attachment band easier to manipulate. Second attachment band 40 is made of an elastic strap as opposed to SPANDEX fabric and measures 0.75" by 9". Additional changes include the reversing of the positions of the male (52*a*) and female (54*a*) buckle portions and the non-slip fabric 46*a* is reduced in overall length by about 50%, being divided into two lengths which will engage opposing sides of the bottle 15 or other container.

The baby bottle leash 20 of the present invention secures the bottle 15 or other container in ready reach of the child even should he/she temporarily lose his/her grip thereon. Because the bottle remains within easy reach, the child may recapture the bottle without requiring intervention of the parent. Even should the parent need to "come to the rescue", rummaging around on the floor of the back seat will not be part of the exercise. Each of the first (30) and second (40) attachment bands have redundant securement means and latching means, respectively, to produce a failsafe system 20 for keeping the bottle 15 or other container, on the leash.

Various changes, alternatives, and modifications will become apparent to a person of ordinary skill in the art after a reading of the foregoing specification. For example, while it is preferred that the attachment band have redundant securement means, it would be possible to simply use the existing padded shoulder strap on the seatbelt harness to cover over the first securement means, i.e., the clip thereby saving the expense of its inclusion. It is intended that all such changes, alternatives, and modifications as fall within the scope of the appended claims be considered part of the present invention.

I claim:

1. A leash system for a child's drink container, said leash system comprising a) a strap having a first and second end;

b) a first attachment band secured to said first end of said strap for suspending said leash system from a shoulder strap of a seatbelt harness, said attachment band having at least a first securement means for suspending said leash from said shoulder strap, said first securement means including a clip for securely gripping the shoulder strap of the seatbelt harness and said first attachment band wraps entirely around said clip and prevents a child from tampering with said clip thereby forming a second securement means;

c) a second attachment band secured to said second end of said strap for securely attaching to the child's drink container, said second attachment band having first and second latching means for securing said attachment band to the child's drink container;

whereby said first and second securement means and said first and second latching means provide a fail-safe leash system for maintaining the child's drink container within reach of a thirsty child.

2. The leash system of claim 1 wherein said second securement means comprises a padded fabric band to ensure the child's comfort.

3. The leash system of claim 2 wherein said band of said second securement means is retained in a wrapped position by first and second portions of hook-and-loop fabric.

4. The leash system of claim 2 wherein said clip is preferably selected from a group consisting of an alligator clip and a suspender clip.

5. The leash system of claim 4 wherein said clip is most preferably a suspender clip.

6. The leash system of claim 5 wherein said suspender clip is sewn inside said band.

7. The leash system of claim 1 wherein said first latching means comprises a width of fabric having length adjustable fastening means attached thereto.

8. The leash system of claim 7 wherein said length adjustable fastening means comprises third and fourth portions of hook-and-loop fabric.

9. The leash system of claim 7 wherein said second latching means comprises a two-part, snap-together buckle, a first part secured to a distal end of a first strap and a second part secured to a distal end of a second strap, said first and second straps overlying and being attached to said width of fabric which constitutes said first latching means.

10. The leash system of claim 1 wherein a length B of said first latching means is not exceed by a length A of said strap.

11. A leash system for a child's drink container, and the like, said leash system comprising a) a strap having a first and second end;

b) a first attachment band secured to said first end of said strap for suspending said leash system from a shoulder strap of a seatbelt harness, or the like, said attachment band having at least a first securement means for suspending said leash from said shoulder strap, said first securement means including a tamper-proof suspender clip for securely gripping the shoulder strap of the seatbelt harness;

c) a second attachment band secured to said second end of said strap for securely attaching to the child's drink container, and the like, said second attachment band having first and second latching means for securing said attachment band to the child's drink container;

whereby said first securement means and said first and second latching means provide a fail-safe leash system for maintaining the child's drink container within reach of a thirsty child.

* * * * *